US005357667A

United States Patent [19]

Schutz

[11] Patent Number: 5,357,667

[45] Date of Patent: Oct. 25, 1994

[54] PROCESS FOR PRODUCING A SHEET-METAL JACKET FOR PALLET CONTAINERS WITH AN INNER CONTAINER OF A SYNTHETIC RESIN

[76] Inventor: Udo Schutz, Ruckersteg 4, D-5418 Selters, Fed. Rep. of Germany

[21] Appl. No.: 11,714

[22] Filed: Feb. 1, 1993

[30] Foreign Application Priority Data

Feb. 12, 1992 [DE] Fed. Rep. of Germany ..... 4204010

[51] Int. Cl.[5] ..... B21D 51/06

[52] U.S. Cl. ..... 29/509; 29/514; 29/521; 29/525.1; 72/379.4; 413/73

[58] Field of Search ..... 29/21.1, 509, 514, 521, 29/525.1; 72/379.4; 413/72–74, 77

[56] References Cited

U.S. PATENT DOCUMENTS

| | | | |
|---|---|---|---|
| 2,620,942 | 12/1952 | Johnson | 413/74 X |
| 3,728,779 | 4/1973 | Behlen et al. | 29/509 X |
| 3,728,881 | 4/1973 | Coop | 29/509 X |
| 3,734,042 | 5/1973 | Heniser et al. | 413/69 |
| 3,759,203 | 9/1973 | Frankenberg | 72/370 |
| 4,534,092 | 8/1985 | Tracy | 29/21.1 |

FOREIGN PATENT DOCUMENTS

| | | | |
|---|---|---|---|
| 663681 | 5/1963 | Canada | 413/77 |
| 2638238 | 6/1984 | Fed. Rep. of Germany . | |

OTHER PUBLICATIONS

Strasser, F., "Sheet Metal Seams", Machine Design, Sep. 9, 1976, pp. 137, 138.

*Primary Examiner*—Mark Rosenbaum
*Assistant Examiner*—S. Thomas Hughes
*Attorney, Agent, or Firm*—Young and Thompson

[57] ABSTRACT

A process for producing sheet-metal jackets, especially for pallet containers with an inner container of a synthetic resin, wherein a rectangular cut-to-size sheet-metal blank, the narrow sides of which are folded over into rims, is bent into a tubular member (15), and the rims (11*a*, 12*a*) of the tubular member (15) are hooked together. From the interlocked rims (11*a*, 12*a*), a series of spaced-apart connecting straps (16) is shaped by cutting and embossing toward the outside in a series parallel to the rims (11*a*, 12*a*) while leaving undeformed the rims between the spaced-apart portions. The rims (11*a*, 12*a*) are locked with respect to each other by a wire (17) pulled through the connecting straps (16), and the thusproduced tubular member (15) is shaped on a stretching press into a sheet-metal jacket.

2 Claims, 3 Drawing Sheets

PROCESS FOR PRODUCING A SHEET-METAL JACKET FOR PALLET CONTAINERS WITH AN INNER CONTAINER OF A SYNTHETIC RESIN

FIELD OF THE INVENTION

The invention relates to a process for the production of sheet-metal jackets, especially for pallet containers with an inner container of a synthetic resin wherein a rectangular cut-to-size blank of steel sheet is bent into a tubular shape, and the abutting rims of the tubular member are firmly joined together, the tubular member of steel sheet is drawn over a stretching press, the expanding jaws of which exhibit the shape of the narrow sides of the plastic inner container, and, by moving the expanding jaws of the stretching press apart, the broad sides of the sheet-metal jacket are stretched up to flow of the material and thus are cold-hardened.

BACKGROUND OF THE INVENTION

In this method, known from DE 26 38 238 C3 for the manufacture of sheet-metal jackets for the plastic inner containers of pallet receptacles wherein the abutting rims of the tubular member, bent from a rectangular sheet-metal blank, are welded together, the weld seam cannot be prevented from tearing in a large number of sheet-metal jackets during the stretching of the tubular members on the stretching press to create sheet-metal jackets. Another drawback of this conventional manufacturing method is to be seen in that expensive welding machines are needed for welding the tubularly bent sheet-metal blanks into tubular members.

The invention is based on the object of further developing the manufacturing process of this type with a view toward a minimum reject rate and the elimination of expensive welding machines.

The manufacturing process of this invention makes it possible to provide a connection of the abutting rims of the tubularly bent cut-to-size sheet-metal blanks which is so firm that tearing of the sheet-metal jackets at the junction sites during the stretching step is precluded, and eliminates the use of expensive welding machines by doing away with the weld seams of the tubular members as the starting material for the sheet-metal jackets.

BRIEF DESCRIPTION OF THE DRAWINGS

The invention is described hereinbelow with reference to the drawings wherein.

DETAILED DESCRIPTION OF THE INVENTION

Figure 1:
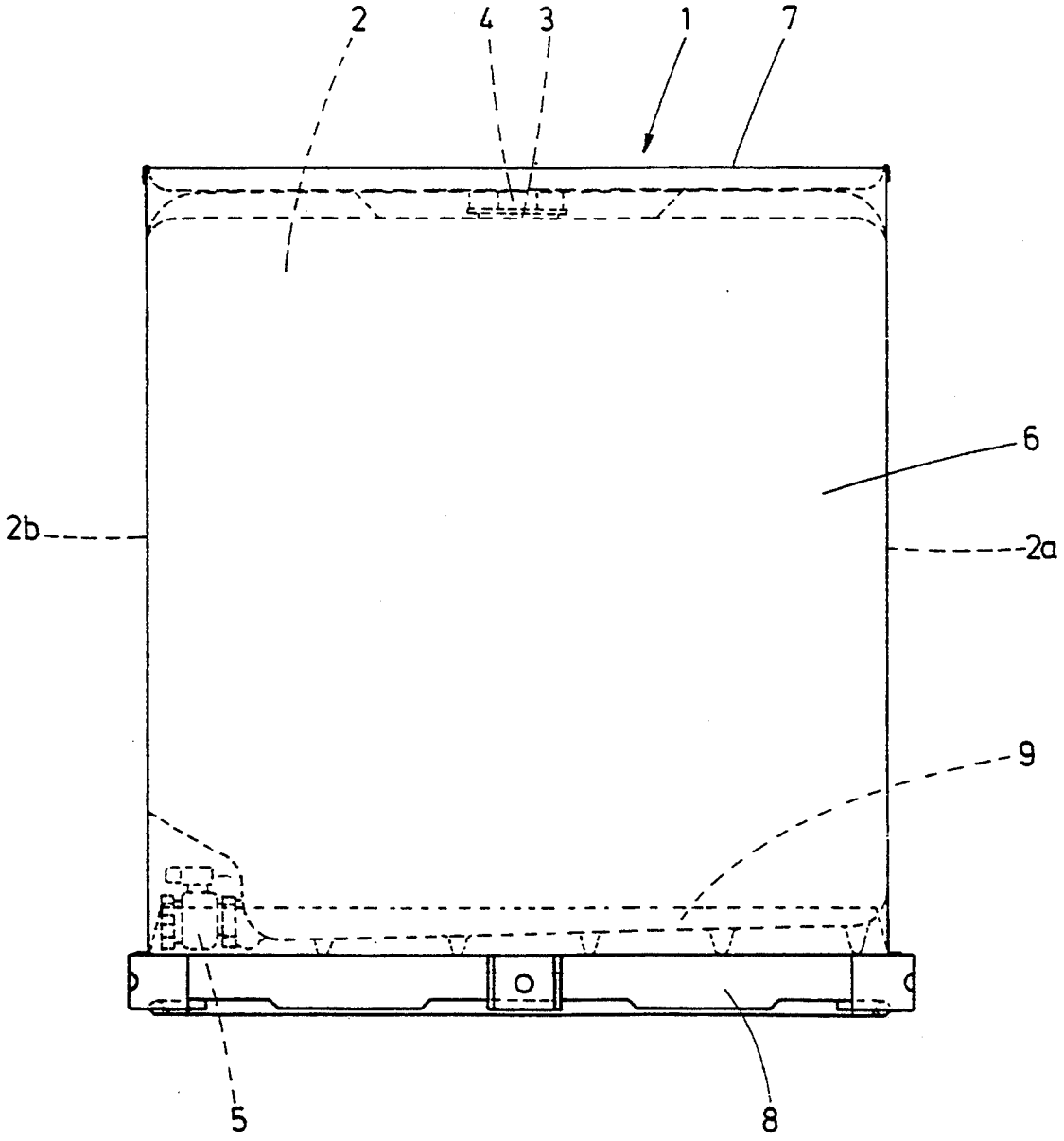
FIG. 1 is a lateral view of a pallet container with a sheet-metal jacket and an inner container of a synthetic resin.
Figure 2:
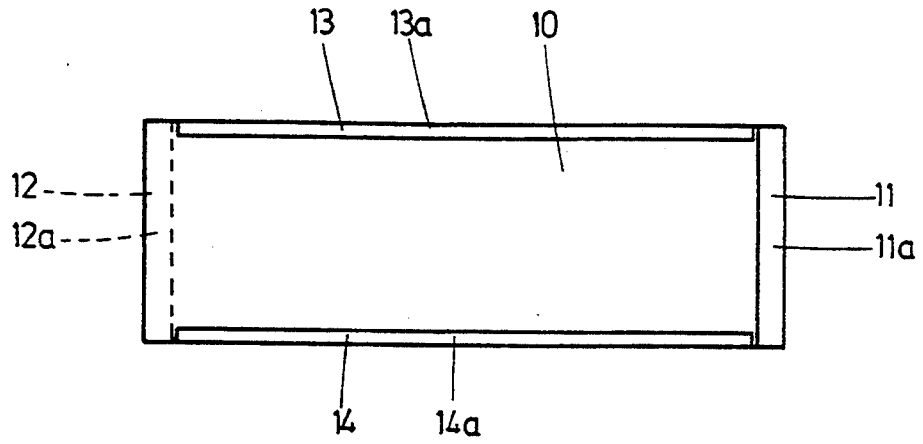
FIG. 2 is a top view of the rectangular sheet-metal blank for producing the tubular member as the starting material for the sheet-metal jacket to be produced on a stretching press.

The pallet container 1 according to FIG. 1 for the shipping and storage of liquids, utilized as a one-way and multipurpose container, comprises as the primary components an exchangeable inner container 2 of polyethylene with a rectangular outline and rounded corners, equipped with a filling nipple 3 sealable by a screw lid 4 and with a drainage valve 5, a sheet-metal jacket 6 with a removable sheet-metal lid 7, as well as a pallet 8 designed as a flat bottom trough 9 of sheet metal, for the shape-mating accommodation of the plastic inner container 2.

Figure 3:
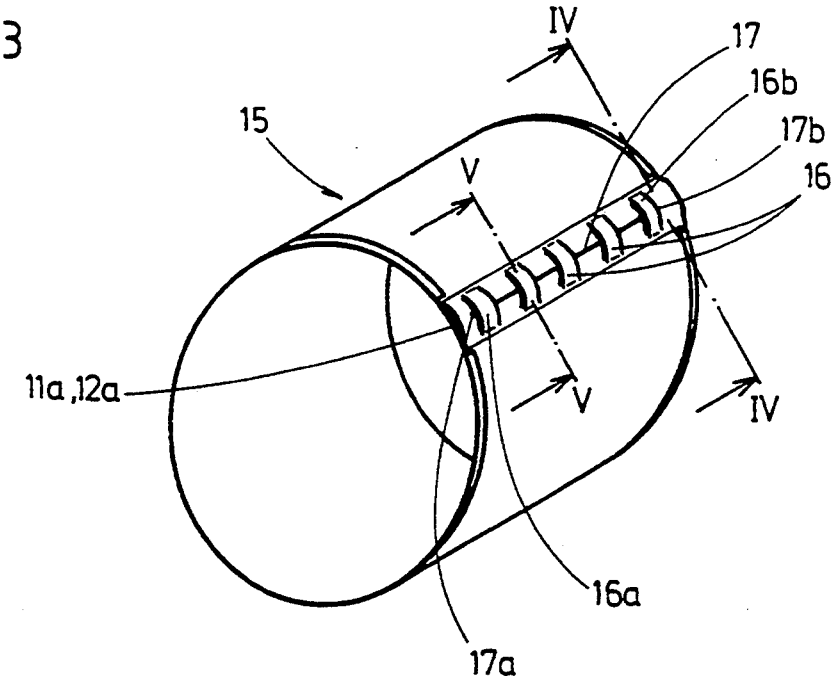
FIG. 3 is a perspective illustration of the tubular member.
Figure 4:
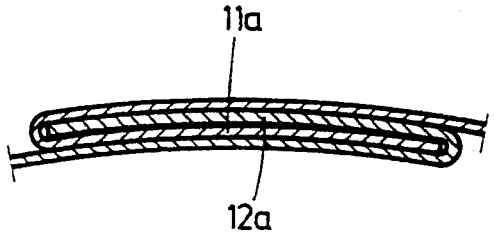
FIGS. 4 and 5 are sections along lines IV—IV and V—V of FIG. 3 on an enlarged scale.
Figure 5:
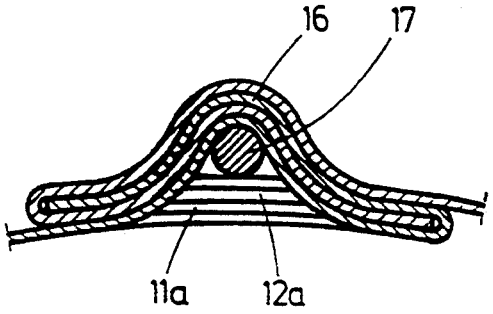
Figure 6:
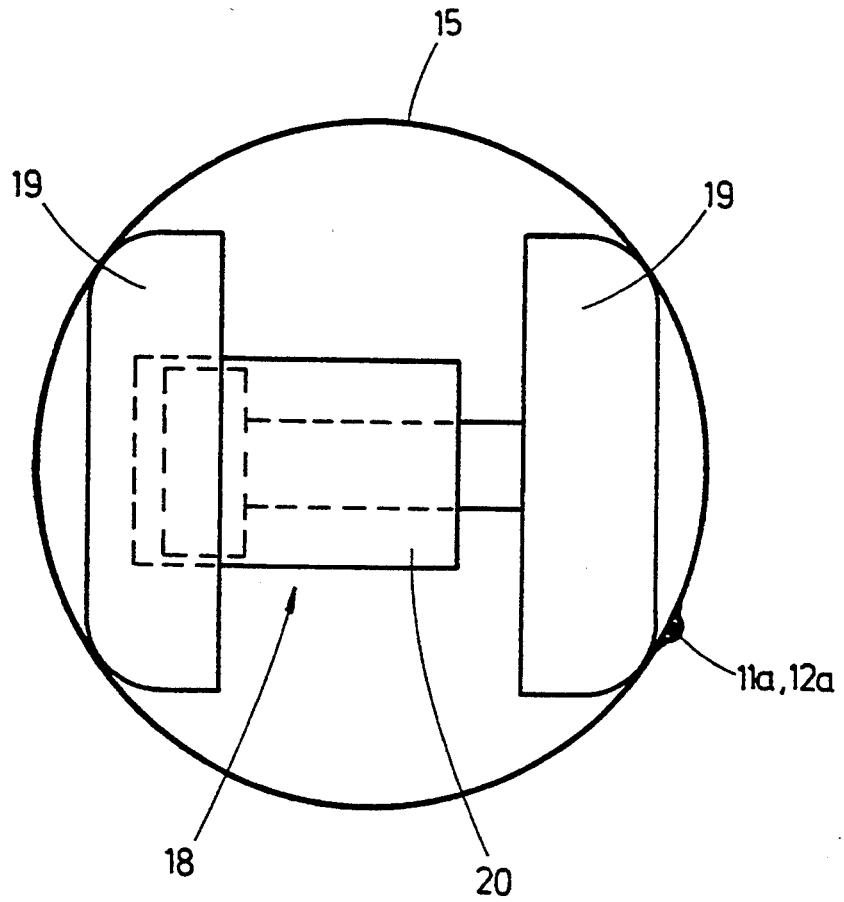
FIGS. 6 and 7 show two phases during stretching of the tubular member on a stretching press to form a sheet-metal jacket.
Figure 7:
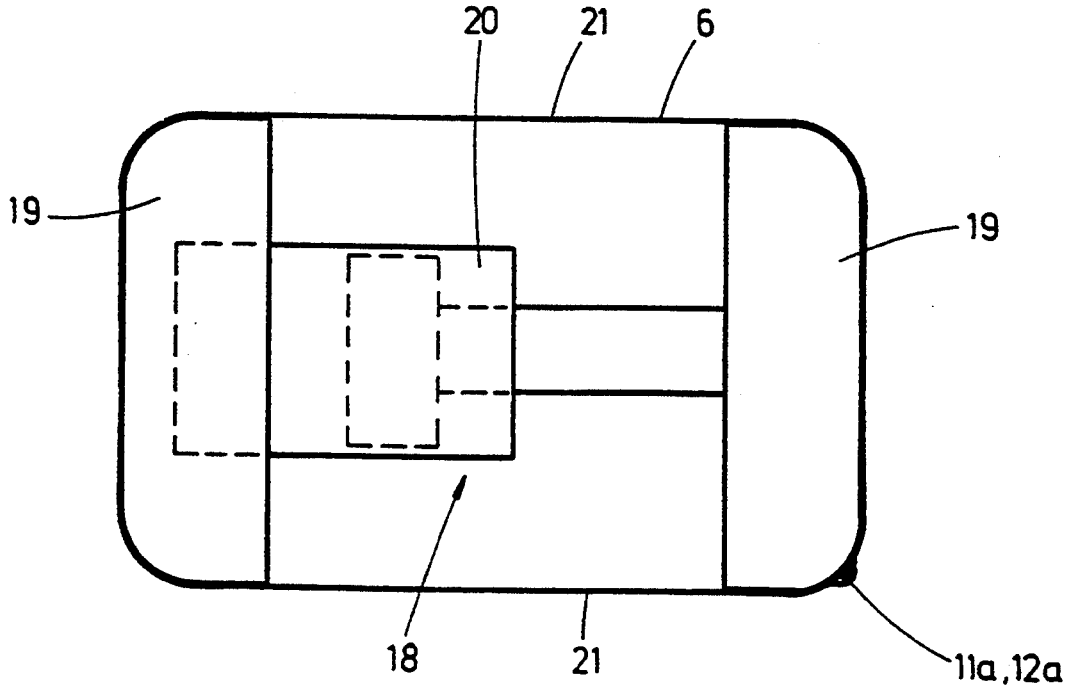

For producing the sheet-metal jacket 6, a rectangular cut-to-size sheet-metal blank 10 of galvanized steel sheet, the narrow sides 11, 12 of which are folded back to rims 11*a*, 12*a* and the broad sides 13, 14 of which are folded back to rims 13*a*, 14*a*, is bent into a tubular member 15, the narrow-side rims 11*a*, 12*a* of which are hooked together (FIGS. 3–5).

From the interlocking rims 11*a*, 12*a* of the tubular member 15, a series of spaced-apart connecting straps 16 is formed by cutting and embossing toward the outside in parallel to the rims 11*a*, 12*a*, and the rims 11*a*, 12*a* are locked with respect to each other by a wire 17 pulled through the connecting straps 16, the ends 17*a*, 17*b* of this wire being attached to the two outer connecting straps 16*a*, 16*b* (FIGS. 3–5). As can be seen from a comparison of FIGS. 4 and 5, it is only the straps 16 that are deformed: the rims between the straps 16 are left undeformed.

The tubular member 15 is pulled over a stretching press 18, the expanding jaws 19 of which exhibit the shape of the narrow sides 2*a*, 2*b* of the plastic inner container 2. Upon application to the stretching press 18, the tubular member 15 is oriented in such a way that the hooked-together rims 11*a*, 12*a* of the tubular member 15 are located in the region of an expanding jaw 19 of the stretching press 18.

When the expanding jaws 19 of the stretching press 18 are moved apart by a pressure medium cylinder 20, the tubular member 15 assumes the shape of the sheet-metal jacket 6. During the stretching step, the tubular member 15 of sheet metal and/or the thus-formed sheet-metal jacket 6 acts like a brake band so that primarily the broad sides 21 of the sheet-metal jacket 6 are stretched, since the expanding jaws 19 are moved apart to such an extent that the sheet-metal material in the broad sides 21 is readily made to flow and even a slight "camber effect" is created in these broad sides. Stretching of the sheet-metal material not only produces a cold hardening thereof but also imparts to the sheet-metal jacket 6 such a final shape that it is in close contact with the plastic inner container 2 and, with a minimum sheet-metal thickness possible, obtains maximum stability. Furthermore, due to the stretching of the sheet-metal jacket 6, material can be saved in the rectangular sheet-metal blank 10, and there is no need for a complicated and expensive special press with large press dies for shaping the sheet-metal jacket 6.

What is claimed is:

1. In a process for the production of a sheet-metal jacket, comprising bending a rectangular cut-to-size blank of steel sheet into a tubular member, joining together abutting rims of the tubular member, drawing the tubular member of steel sheet over a stretching press having expanding jaws, and, by moving the expanding jaws of the stretching press apart, stretching broad sides of the sheet-metal jacket to cause flow of the sheet-metal and thus to cold-harden the sheet-metal; the improvement comprising performing said joining step by folding narrow sides of the rectangular sheet-metal blank back to form folded rims, hooking the folded rims of the tubular member bent from the sheet-metal blank together, forming a series of spaced-apart connecting straps by cutting and embossing outwardly spaced-apart portions of the folded rims while leaving portions of the rims between said spaced-apart portions undeformed, and inserting a wire through the connecting straps to lock the folded rims together prior to performing said drawing and stretching steps, the improvement further comprising performing said stretching step with a single expanding jaw of the stretching press in contact with the hooked-together folded rims of the tubular member.

2. Process according to claim 1, the improvement further comprising attaching the locking wire at its ends to two of the connecting straps.

* * * * *